US007369805B2

(12) United States Patent
Kim et al.

(10) Patent No.: US 7,369,805 B2
(45) Date of Patent: May 6, 2008

(54) FUSING DEVICE OF ELECTROPHOTOGRAPHIC IMAGE FORMING APPARATUS

(75) Inventors: Jin-yoon Kim, Gunpo-si (KR); Seung-yoon Lee, Suwon-si (KR); Gwon-cheol Lee, Seoul (KR)

(73) Assignee: Samsung Electtronics Co., Ltd., Suwon-Si (KR)

( * ) Notice: Subject to any disclaimer, the term of this patent is extended or adjusted under 35 U.S.C. 154(b) by 171 days.

(21) Appl. No.: 10/989,460

(22) Filed: Nov. 17, 2004

(65) Prior Publication Data

US 2005/0141934 A1 Jun. 30, 2005

(30) Foreign Application Priority Data

Dec. 24, 2003 (KR) ..... 10-2003-0096199

(51) Int. Cl.
*G03G 15/20* (2006.01)

(52) U.S. Cl. ..... 399/330; 219/216

(58) Field of Classification Search ..... 399/330; 219/216, 469–471
See application file for complete search history.

(56) References Cited

U.S. PATENT DOCUMENTS 4,874,927 A * 10/1989 Shibata et al. ..... 219/469
5,585,909 A * 12/1996 Behe et al. ..... 219/216
6,096,995 A * 8/2000 Toyota et al. ..... 219/216
6,252,199 B1 * 6/2001 Toyota et al. ..... 219/216
6,285,006 B1 * 9/2001 Hyllberg ..... 219/216
6,345,169 B1 * 2/2002 Haneda et al. ..... 219/216
6,470,167 B2 * 10/2002 Hwang ..... 219/216
6,571,080 B2 * 5/2003 Lee et al. ..... 399/330
6,580,895 B2 * 6/2003 Hirst et al. ..... 399/330
6,628,917 B2 9/2003 Lee
6,665,515 B2 * 12/2003 Lee ..... 399/330

FOREIGN PATENT DOCUMENTS

JP 1-314274 12/1989
JP 6-67558 3/1994
JP 06161313 A * 6/1994
JP 6-202515 7/1994
JP 10-3223 1/1998
JP 2001-56020 2/2001

* cited by examiner

*Primary Examiner*—Susan Lee
(74) *Attorney, Agent, or Firm*—Staas & Halsey LLP

(57) ABSTRACT

A fusing device of an electrophotographic image forming apparatus. The fusing device includes a fusing roller that is heated to be a predetermined temperature, and a pressing roller that presses a sheet of paper passing between the fusing roller and the pressing roller toward the fusing roller. In addition, the fusing roller includes a cylindrical roller having a predetermined diameter, a heater positioned inside the cylindrical roller to heat the cylindrical roller, a rubber member that is formed on a center portion of an outer circumference on the cylindrical roller, and heat resistance portion that is formed on both end portions of the cylindrical roller.

6 Claims, 7 Drawing Sheets

FUSING DEVICE OF ELECTROPHOTOGRAPHIC IMAGE FORMING APPARATUS

CROSS-REFERENCE TO RELATED APPLICATION

This application claims the priority of Korean Patent Application No. 2003-96199, filed on Dec. 24, 2003, in the Korean Intellectual Property Office, the disclosure of which is incorporated herein in its entirety by reference.

BACKGROUND OF THE INVENTION

1. Field of the Invention

The present invention relates to a fusing device of an electrophotographic image forming apparatus, and, more particularly, to a structure of end portions of a fusing roller.

2. Description of the Related Art

Generally, in an electrophotographic color image forming apparatus such as a color laser printer, a predetermined electrostatic latent image is formed on a photosensitive body, and the electrostatic latent image is developed with a toner, and the developed resultant is transferred onto a sheet of paper after passing through a predetermined transfer medium. In addition, the resultant that is transferred on the sheet of paper is heated and pressed to be permanently fused thereon.

Referring to FIG. 1, the conventional electrophotographic color image forming apparatus includes a photosensitive drum 10, a charger 11 that charges the photosensitive drum 10, a laser scanning unit 12 that is a light scanning unit to form a predetermined electrostatic latent image on the charged photosensitive drum 10 by scanning the light, a developing unit 13 that develops the electrostatic latent image with toners of four colors, that is, yellow (Y), magenta (M), cyan (C), and black (K) colors, a transfer belt 14 that sequentially overlaps the images of four colors formed on the photosensitive drum 10, a first transfer roller 14*a* that transfers the four color images that is developed on the photosensitive drum 10 onto the transfer belt 14, a second transfer roller 14*b* that transfers the four color images on the transfer belt 14 onto the sheet of paper, and a fusing device 15 that heats and presses the sheet of paper to permanently fuse the transferred image on the sheet of paper.

Reference numeral 16 denotes a paper cassette, reference numeral 17 denotes a blade to clean the photosensitive drum, reference numeral 18 denotes an eraser, and reference numeral 19 denotes a conveying path through which the sheet of paper may be discharged.

The fusing device 15 heats the sheet of paper, on which the toner images are transferred to melt the toner image in a powder state and to fuse the image on the sheet of paper. The fusing device 15 includes a fusing roller that fuses the toner on the sheet of paper, and a pressing roller that pushes the sheet of paper toward the fusing roller.

The fusing roller is formed as a cylindrical roller made of metal, such as stainless steel, that has a rubber member formed on a circumference thereof. The metal cylindrical roller allows a temperature of the fusing roller to be substantially uniform, and the rubber member softly contacts the sheet of paper that passes between the pressing roller and the fusing roller.

The fusing roller is a rotating body and has a structure that allows an electrical connection to a heating element to be included therein.

U.S. Pat. No. 6,628,917 discloses a fusing roller, both sides of which are attached by end caps. The end cap is a resin such as polyphenylene sulfide (PPS), polybutylene terephthalate (PBT), or a nylon that is filled with a filler, such as glass fiber, having a low thermal conductivity at a high temperature.

When a surface temperature of the fusing roller is high, the temperature of the cylindrical roller is higher than the surface temperature of the fusing roller, and the end cap may melt.

On the other hand, Japanese Laid-open Patent No. H10-3223 discloses a fusing roller that has bearings installed on both end portions thereof, and a gear is installed on one end portion of the fusing roller. Here, an adiabatic member is used between the fusing roller and the bearing.

SUMMARY OF THE INVENTION

Therefore, the present invention provides a fusing device of an electrophotographic image forming apparatus. The fusing device has an improved end structure so as to prevent a rotating member from being damaged by heat transmission occurring on both ends of the fusing roller.

According to an aspect of the present invention, the fusing device includes a fusing roller that is heated to a predetermined temperature, and a pressing roller that presses a sheet of paper passing between the fusing roller and the pressing roller toward the fusing roller. The fusing roller includes a cylindrical roller having a predetermined diameter, a heater positioned inside the cylindrical roller to heat the cylindrical roller, a rubber member that is formed on a center portion of an outer circumference on the cylindrical roller, and heat a resistance portion that is formed on both end portions of the cylindrical roller.

According to other aspects of the present invention, the heat resistance portion may comprise at least one or more holes formed on each of the end portions of the cylindrical roller. The hole may be formed to be long in a perpendicular direction with respect to a rotary shaft direction of the cylindrical roller. The hole may be filled with a resin, including ceramic filler. The heat resistance portion may include at least one or more grooves that are formed on both ends of the cylindrical roller, and the grooves are filled with the resin, including ceramic filler. Lastly, the recess may be formed to be long in a perpendicular direction with respect to a shaft direction of the cylindrical roller.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
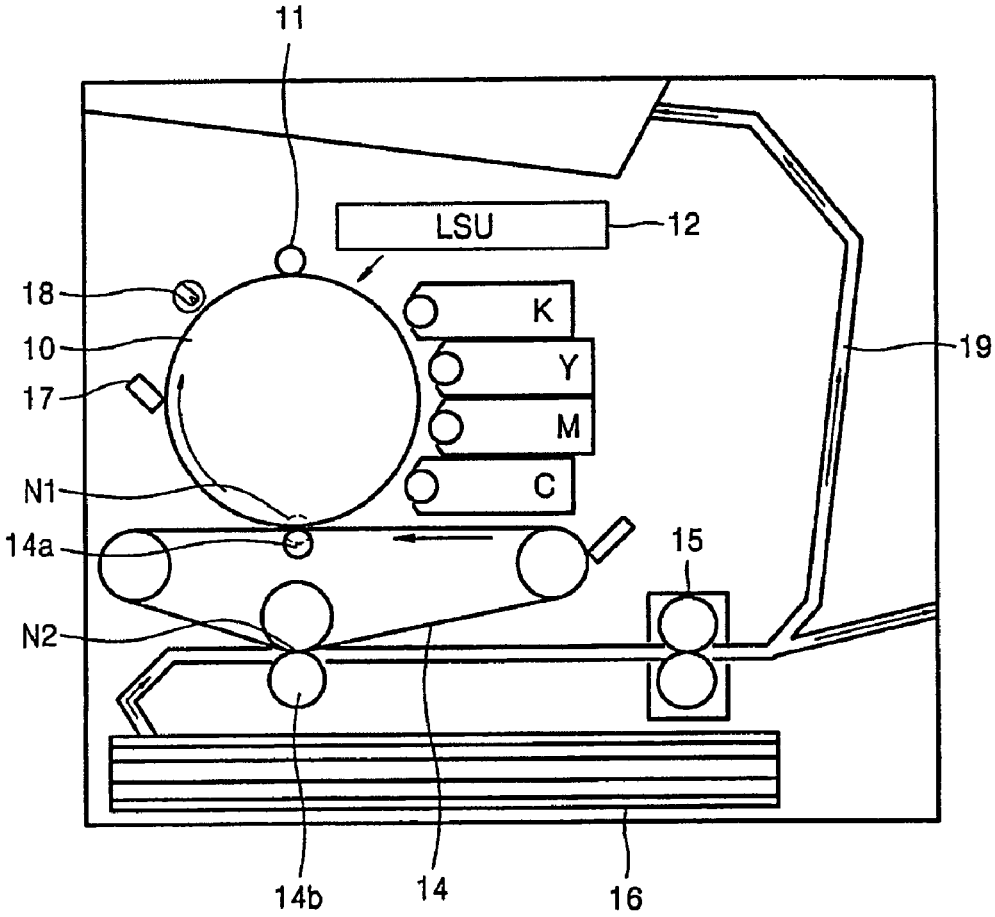
FIG. 1 (PRIOR ART)
FIG. 1 is a schematic view illustrating a conventional electrophotographic color image forming apparatus.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
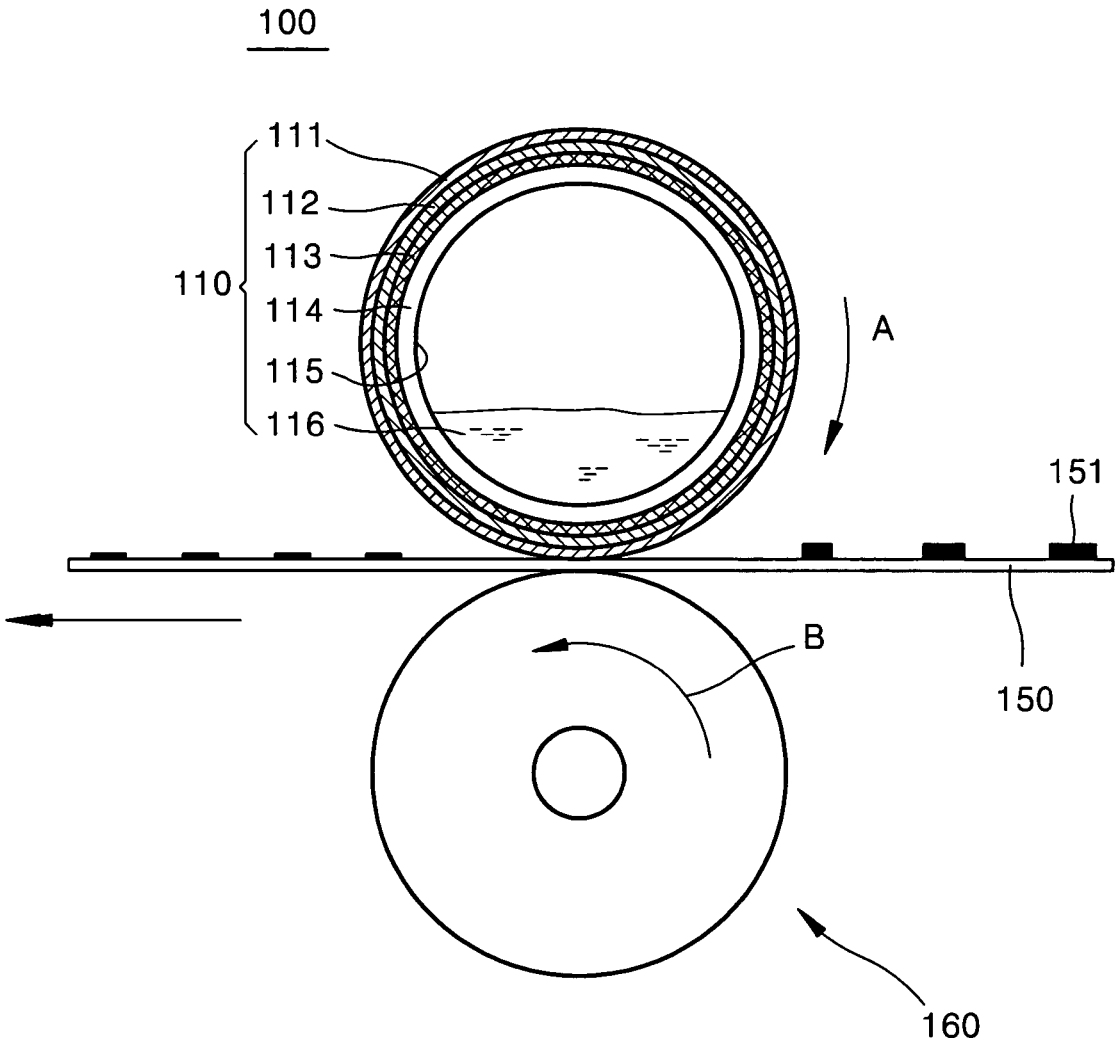
FIG. 2 is a schematic cross-sectional view illustrating a fusing device of an electrophotographic image forming apparatus according to the present invention.
Figure 3:
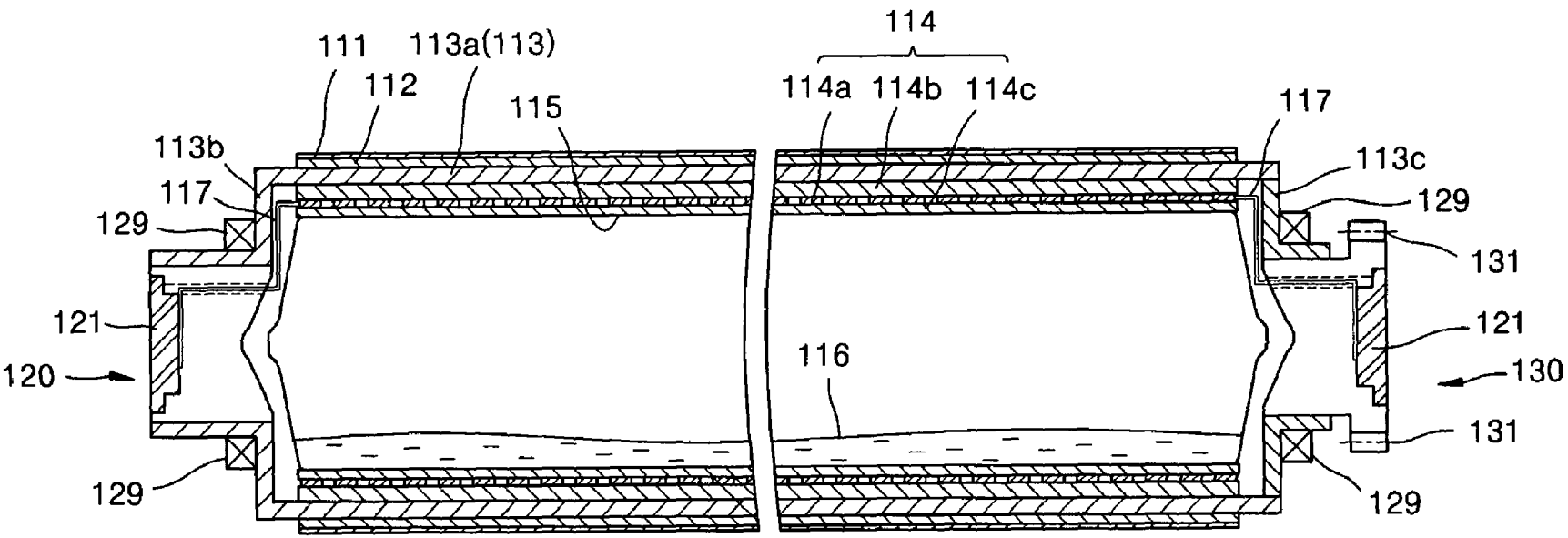
FIG. 3 is a longitudinal cross-sectional view illustrating the fusing roller shown in FIG. 2.

FIG. 2 is a schematic cross-sectional view illustrating a fusing device of an electrophotographic image forming apparatus according to the present invention, and FIG. 3 is a longitudinal cross-sectional view illustrating a fusing roller shown in FIG. 2.

Referring to FIGS. 2 and 3, the fusing device 100 includes a fusing roller 110 having a cylindrical roller 113 that rotates in a direction of an arrow A, which corresponds to a discharging direction of a sheet of paper 150 on which a toner image 151 is formed. The fusing device 100 further includes a pressing roller 160 that faces the fusing roller 110 the sheet of paper 150 interposed therebetween. The pressing roller 160 rotates in a direction of an arrow B while pressing the sheet of paper 150 toward the fusing roller 110.

As illustrated in FIG. 3, the cylindrical roller 113 includes a cylinder portion 113*a* and stepped portions 113*b* and 113*c* on both end portions of the cylinder portion 113*a*. A silicon rubber layer 112 having a substantially 1.5 mm thickness is formed on a surface of the cylinder portion 113*a*, and a toner release layer 111 that is made of teflon to be about 20~30 μm thick is formed on the silicon rubber layer 112. A heat generator 114 is disposed inside the cylindrical roller 113. Meanwhile, a heat pipe 115, both end portions of which are sealed so as to maintain a predetermined pressure therein, is disposed inside the heat generator 114. According to various embodiments of the invention, the thickness of the silicon rubber layer 112 may be varied according to surface material used in the pressing roller 160.

Swaging the end portion of the cylinder to form the step inward forms the stepped portion 113*b* that is connected to an end portion of the cylinder portion 113*a*. Accordingly, the stepped portion 113*b* and the cylinder portion 113*a* are formed integrally with each other. The stepped portion 113*c* that is connected to the other end portion of the cylinder portion 113*a* is coupled to the cylinder portion 113*a* via a screw combination. That is, a female screw is formed on the end portion of the cylinder portion 113*a*, and a male screw corresponding to the female screw is formed on the stepped portion 113*c*. In another embodiment of the invention, the screw combination may be reversed. In the above structure, in which one end portion of the cylindrical roller 113 may be opened, the heat pipe 115 and the heat generator 114 having larger diameters than those of the stepped portions 113*b* and 113*c* are put into the cylindrical roller 113, and a pressure substantially equal to 100~150 times atmospheric_pressure is pressed into the inner portion of the heat pipe 115 to expand the heat pipe 115. Then the heat generator 114 may be closely adhered to an outer circumferential surface of the heat pipe 115 and an inner circumferential surface of the fusing roller 113. Thereafter, the stepped portion 113*c* may be coupled to the corresponding end portion of the cylinder portion 113*a* by a screwing motion. On the other hand, ball bearings 129 are installed on the stepped portions 113*b* and 113*c* to support the fusing roller 110 that includes the stepped portions 113*b* and 113*c*.

The heat generator 114 includes a Ni—Cr resistance coil 114*a* that generates heat via externally supplied electricity, a set of magnesium oxide (MgO) layers 114*b* and 114*c* that surround the resistance coil 114*a*, and lead wires 117 that apply electricity to both ends of the resistance coil 114*a* of the heat generator 114. A Cr—Fe wire may be used as the resistance coil 114*a*.

The heat pipe 115 is a pipe having end portions sealed. A predetermined amount of working fluid 116 is contained in the heat pipe 115. The working fluid 116 functions as a heat medium that is vaporized by the heat generated by the heat generator 114 to transmit the heat to the cylindrical roller 113, prevent the temperature variation on the surface of the cylindrical roller 113, and heat the entire cylindrical roller 113 rapidly.

The temperature on the surface of the silicon rubber layer 112 that directly contacts the sheet of paper 150, on which the toner image is transferred, through the toner release layer 111 should be maintained at approximately 175° C. However, the temperature on the inner surface of the silicon rubber layer 112, which contacts the cylindrical roller 113, may rise to 230~240° C. Thus, silicon material that is durable against such high temperatures is used.

The cylindrical roller 113 is heated by the heat generated by the heat generator 114 or evaporation heat of the working fluid 116 that is contained in the heat pipe 115, and transmits the heat to the silicon rubber layer 112 to melt the toner 151 of powder state formed on the sheet of paper 150. The cylindrical roller 113 is made of stainless steel, aluminum (Al), or copper (Cu).

A first end cap 120 and a second end cap 130 are inserted into the both sides of the fusing roller 110. The second end cap 130 has a substantially similar structure to that of the first end cap 120. However a difference between the two features is that, in the second end cap 130 a gear 131 is formed along the outer circumferential surface of the second end cap 130 and rotates by engaging with a gear of a motor.

Figure 4A:
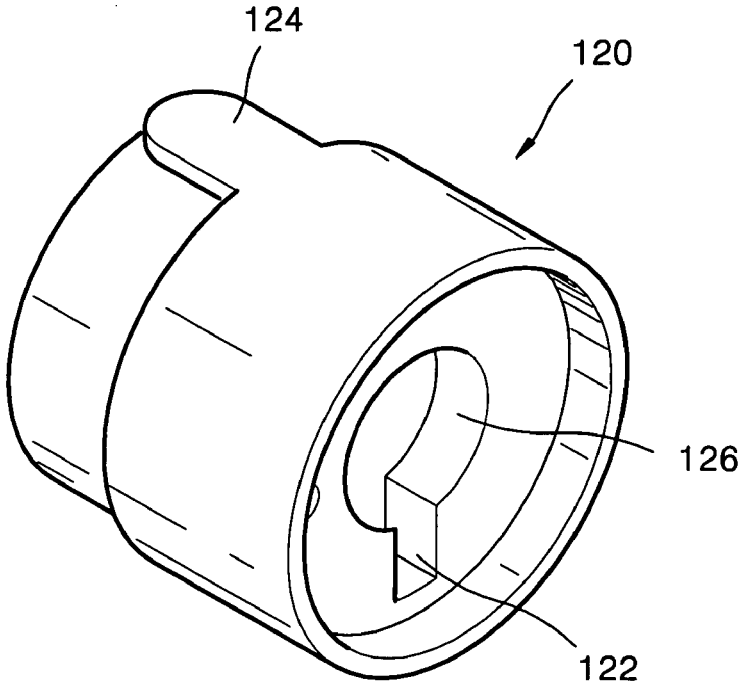
FIGS. 4*a* and 4*b* are perspective views illustrating a first end cap of FIG. 3.
Figure 4B:
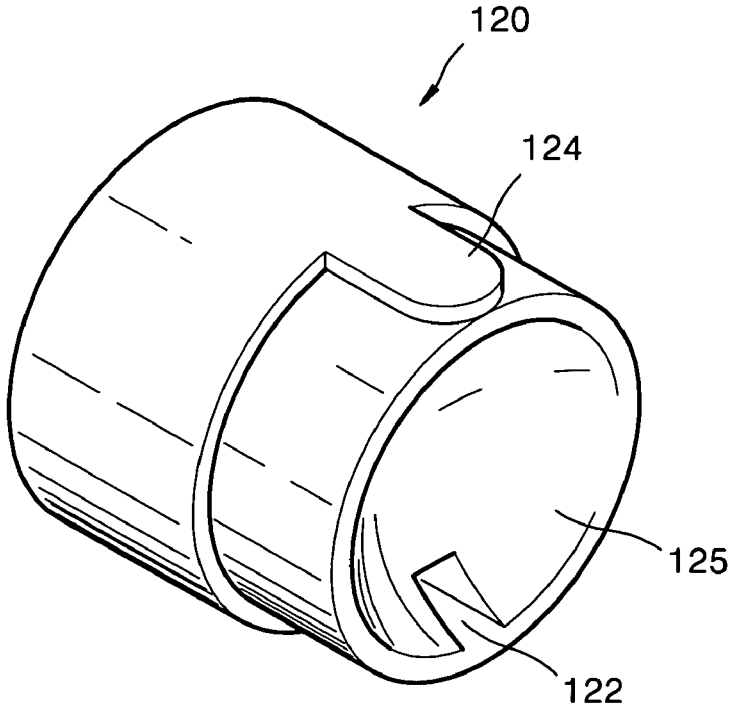
Figure 5A:
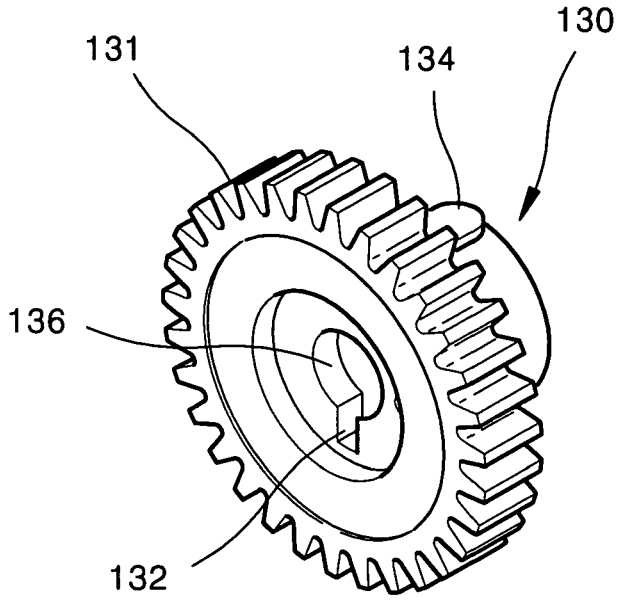
FIGS. 5*a* and 5*b* are perspective views illustrating a second end cap of FIG. 3.
Figure 5B:
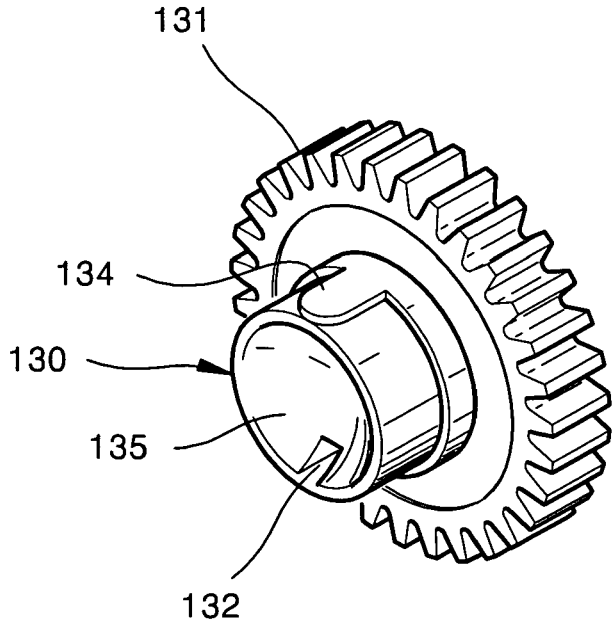

FIGS. 4*a* and 4*b* are perspective views of the first end cap 120 shown in FIG. 3, and FIGS. 5*a* and 5*b* are perspective views of the second end cap 130 shown in FIG. 3.

Referring to FIGS. 4*a* and 5*b*, lead holes 122 and 132, through which the leads (refer to 117 of FIG. 3) that are connected to the both ends of the resistance coil 113*a* pass, are formed on the first end cap 120 and the second end cap 130. Protrusion keys 124 and 134 are formed on circumferential portions of the end caps 120 and 130. The protrusion keys 124 and 134 are engaged with key recesses (not shown) formed inside of the stepped portions 113*b* and 113*c*. Concave portions 125 and 135, into which end portions of the heat pipe 115 are partially inserted, are formed at inner center portions of the end caps 120 and 130 that face both of the ends of the heat pipe 115. Electrode recesses 126 and 136, into which electrodes 121 are inserted, are formed on outer center portions of the end caps 120 and 130. That is, the electrode recesses 126 and 136 are found on the opposite side of the concave portions 125 and 135. The electrodes 121 supply the electricity to the lead 117 that is inserted into the lead holes 122 and 132 and bent at a right angle.

The end caps 120 and 130 may be fabricated using a resin such as a polyphenylene sulfide (PPS), a polybutylene terephthalate (PBT), and a nylon that is filled with a filler such as glass fibers. The glass fiber filled nylon may be advantageous because this material is less transformed by heat of a high temperature environment.

On the other hand, the fusing device of the present invention includes a heat resistance portion to thermally protect the end caps 120 and 130 and the bearings 129.

Figure 6:
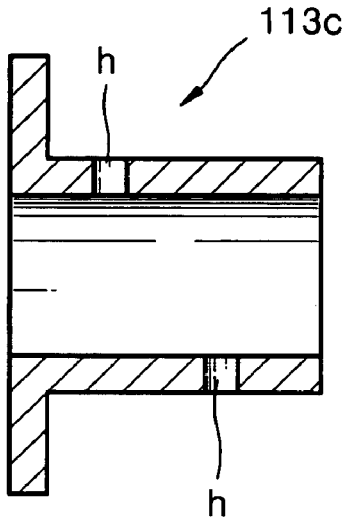
FIG. 6 is a cross-sectional view illustrating an end portion of the fusing roller, at which an embodiment of heat resistance portion is formed.
Figure 7:
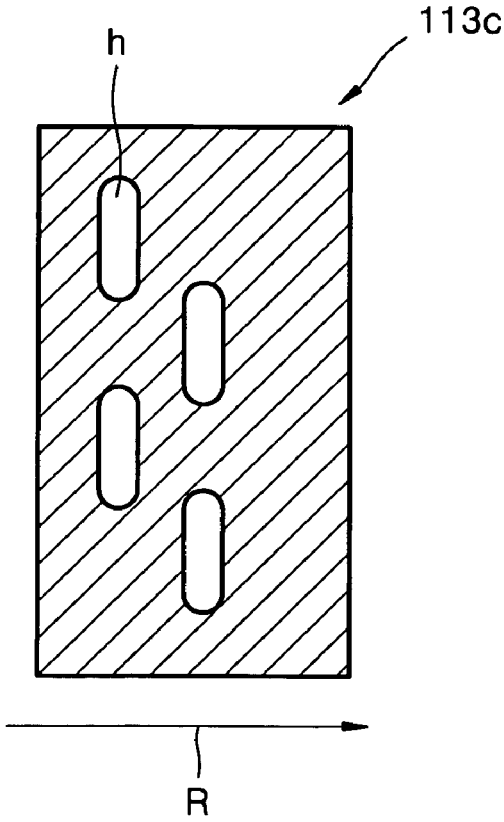
FIG. 7 is a plan view illustrating a circumferential surface of the end portion of the fusing roller shown in FIG. 6.

FIG. 6 is a cross-sectional view illustrating an end portion of the fusing device, on which an embodiment of the heat resistance portion is formed, and FIG. 7 is a plan view spreading the circumferential surface of the end portion of the fusing roller shown in FIG. 6.

Referring to FIGS. 6 and 7, a plurality of holes (h) are formed on both ends of the fusing roller. The holes h are formed to be long in a perpendicular direction with respect to a direction of a rotary shaft denoted by an arrow R. The holes h reduce the amount of heat transmitted from the center portion of the cylindrical roller to the end caps 120 and 130 and the bearings 129.

Heat capacity is represented by following equation 1.

$$Q_{cond} = -kA\frac{dT}{dx} \tag{1}$$

where $Q_{cond}$ denotes thermal conductive quantity, T denotes a temperature of the cylindrical roller, k denotes a thermal conductivity of the cylindrical roller material, A is a heat transfer area (end portion of the cylindrical roller), and x denotes a distance of a heat conductive portion.

According to equation 1, a plurality of holes h formed on the end portions of the cylindrical roller 113 reduce the conduction heat from the cylindrical roller 113 to the heat conducted portion, for example, the bearings 129 or the end caps 120 and 130.

In FIG. 6, since the holes h are formed to be long in a perpendicular direction with respect to the heat conducting direction, the conduction heat may be reduced by increasing by decreasing the heat transfer area, that is, A in equation 1.

Figure 8:
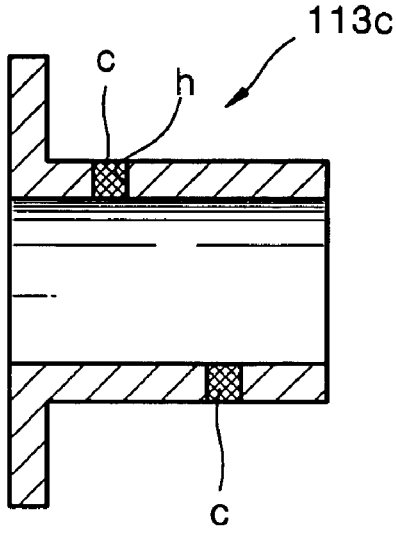
FIG. 8 is a cross-sectional view illustrating an end portion of the fusing roller, at which another embodiment of the heat resistance portion is formed.

FIG. 8 is a cross-sectional view illustrating an end portion of the fusing roller, at which another embodiment of the heat resistance portion is formed.

Referring to FIG. 8, a plurality of holes h are formed on both end portions of the fusing roller. The holes h are filled with the resin (c) that includes a ceramic filler having low heat conductivity than that of the cylindrical roller 113, such as an alumina. As discussed above, the PPS, PBT, or the nylon may be used as the resin since the advantages of these materials as used in the previously mentioned embodiments have similar effects here.

The material filled in the holes h reduces the quantity of heat that is transmitted from the center portion of the cylindrical roller to the end caps 120 and 130 and the bearings 129.

Figure 9:
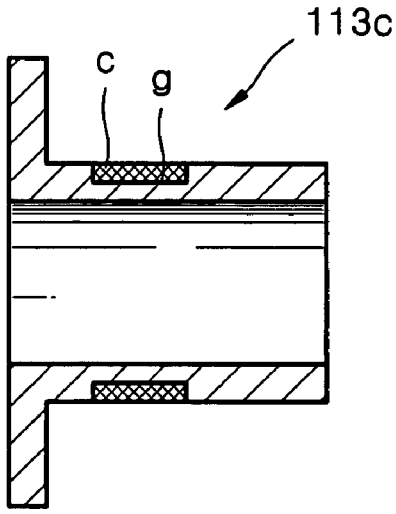
FIG. 9 is a cross-sectional view illustrating an end portion of the fusing roller, at which still another embodiment of the heat resistance portion is formed.

FIG. 9 is a cross-sectional view illustrating an end portion of the fusing device, at which still another embodiment of the heat resistance portion is formed.

Referring to FIG. 9, grooves (g) are formed on both end portions of the cylindrical roller, and the grooves are filled with the resin (c) including a material having lower heat conductivity than that of the cylindrical roller 113, for example, the ceramic filler such as alumina. The material filled in the grooves g reduces the quantity of heat transferred from the center portion of the cylindrical roller 113 to the end caps 120 and 130 and the bearings 129.

As is described above, since the fusing roller of the electrophotographic image forming apparatus according to the present invention includes the heat resistance portion on both ends of the fusing roller to reduce quantity of the heat transmitted from the fusing roller to the bearings and end caps, transformation of the bearing or the end cap due to the heat can be prevented.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A fusing device of an electrophotographic image forming apparatus comprising:

a fusing roller that is heated to a predetermined temperature; and a pressing roller to press a sheet of paper that passes between the fusing roller and the pressing roller toward the fusing roller, wherein the fusing roller comprises:

a cylindrical roller having a cylinder portion having a predetermined diameter and stepped portions formed on ends of the cylinder portion;

a heater positioned inside the cylindrical roller to heat the cylindrical roller;

a rubber member formed on a surface of the cylindrical roller; and a heat resistance portion that is formed on the stepped portions of the cylindrical roller, wherein the heat resistance portion comprises at least one or more holes formed on each of the stepped portions of the cylindrical roller.

2. The fusing device of claim 1, wherein the hole is long in a perpendicular direction with respect to a rotary shaft direction of the cylindrical roller.

3. fusing device of an electrophotographic image forming apparatus comprising:

a fusing roller that is heated to a predetermined temperature; and a pressing roller to press a sheet of paper that passes between the fusing roller and the pressing roller toward the fusing roller, wherein the fusing roller comprises:

a cylindrical roller having a cylinder portion having a predetermined diameter and stepped portions formed on ends of the cylinder portion;

a heater positioned inside the cylindrical roller to heat the cylindrical roller;

a rubber member formed on a surface of the cylindrical roller; and a heat resistance portion that is formed on the stepped portions of the cylindrical roller, wherein the heat resistance portion comprises at least one or more holes formed on each of the stepped portions of the cylindrical roller, wherein the hole is filled with a resin including a ceramic filler.

4. A fusing device of an electrophotographic image forming apparatus comprising:

a fusing roller that is heated to a predetermined temperature; and a pressing roller to press a sheet of paper that passes between the fusing roller and the pressing roller toward the fusing roller, wherein the fusing roller comprises:

a cylindrical roller having a cylinder portion having a predetermined diameter and stepped portions formed on ends of the cylinder portion;

a heater positioned inside the cylindrical roller to heat the cylindrical roller;

a rubber member formed on a surface of the cylindrical roller; and a heat resistance portion that is formed on the stepped portions of the cylindrical roller, wherein the heat resistance portion comprises at least one or more holes formed on each of the stepped portions of the cylindrical roller, wherein the heat resistance portion includes at least one or more grooves that are formed on both ends of the cylindrical roller, the grooves being filled with a resin.

5. The fusing device of claim 4, wherein the resin filling the grooves comprises a ceramic filler.

6. The fusing device of claim 4, wherein the grooves are long in a perpendicular direction with respect to a shaft direction of the cylindrical roller.

* * * * *

UNITED STATES PATENT AND TRADEMARK OFFICE

CERTIFICATE OF CORRECTION

PATENT NO. : 7,369,805 B2
APPLICATION NO. : 10/989460
DATED : May 6, 2008
INVENTOR(S) : Jin-yoon Kim et al.

It is certified that error appears in the above-identified patent and that said Letters Patent is hereby corrected as shown below:

Title Page, column 1 Item [73] (Assignee), Line 1, change “Electtronics” to --Electronics--.

Column 6, Line 42 Claim 2, change “fusing” to --A fusing--.

Signed and Sealed this

Seventh Day of October, 2008

JON W. DUDAS
*Director of the United States Patent and Trademark Office*